US005700341A

United States Patent [19]

Steelman et al.

[11] Patent Number: 5,700,341

[45] Date of Patent: Dec. 23, 1997

[54] METHODS FOR REDUCING SURFACE FRICTION IN FIBER OPTIC DISPENSERS

[75] Inventors: Michael L. Steelman, Fayetteville; Calvin W. Long, Tullahoma, both of Tenn.

[73] Assignee: The United States of America as represented by the Secretary of the Army, Washington, D.C.

[21] Appl. No.: 778,062

[22] Filed: Dec. 23, 1996

[51] Int. Cl.[6] ..... B65H 81/00; B65H 55/04

[52] U.S. Cl. ..... 156/172; 156/169; 242/172; 242/173

[58] Field of Search ..... 156/169, 166, 156/172, 173, 175; 242/172, 173

[56] References Cited

U.S. PATENT DOCUMENTS

| | | | |
|---|---|---|---|
| 2,739,371 | 3/1956 | Grisdale et al. | 242/173 X |
| 4,508,761 | 4/1985 | Miyoshi et al. . | |
| 4,703,075 | 10/1987 | Egami . | |
| 5,064,490 | 11/1991 | Chapin et al. | 242/173 X |
| 5,154,839 | 10/1992 | Hanano . | |
| 5,161,208 | 11/1992 | Christie et al. | 242/173 X |
| 5,194,112 | 3/1993 | Allan | 242/173 X |
| 5,560,558 | 10/1996 | Wray | 242/172 X |

FOREIGN PATENT DOCUMENTS

| | | | |
|---|---|---|---|
| 1209591 | 10/1970 | United Kingdom | 242/172 |

*Primary Examiner*—Jeff H. Aftergut

*Attorney, Agent, or Firm*—Hugh P. Nicholson; Freddie M. Bush; Hay Kyung Chang

[57] ABSTRACT

Reduction of the surface friction of a cured elastomer, sealant or adhesive is accomplished through the use of a dry lubricant such as hexagonal boron nitride powder either as an additive to the uncured polymer mix or applied to the uncured polymer surface prior to effecting a cure.

1 Claim, 1 Drawing Sheet

METHODS FOR REDUCING SURFACE FRICTION IN FIBER OPTIC DISPENSERS

DEDICATORY CLAUSE

The invention described herein may be manufactured, used and licensed by or for the Government for governmental purposes without the payment to us of any royalties thereon.

BACKGROUND OF THE INVENTION

A fiber optic payout dispenser provides a communication link between a control station and a vehicle such as a missile, bomb or ground vehicle on which the dispenser resides. The dispenser allows the deployment of optical fiber during the vehicle travel by unspooling or peeling off. A fiber optic dispenser consists of a bobbin or mandrel which provides support and a baselayer which provides guidance for layers of optical fiber. Optical fiber is wound onto the baselayer in a tight helical pattern with multiple layers following the grooves formed by underlying layers. During the winding of optical fiber, an adhesive is applied as a binder to provide mechanical stability to the wound layers of fiber.

Existing technology used in the production of payout dispensers typically utilizes polymer-based adhesives as a binder. During payout deployment, the fiber being payed out is often in contact with and rubbing against other material surfaces. These material surfaces include the surface of the optical fiber and any adhesive used to secure the optical fiber. These fictional effects are increased at high speeds of payout. Dynamic surface frictional forces resulting from this rubbing contact can contribute significantly to the transient tension encountered by the optical fiber and can produce fiber failure during payout. In addition, transient forces on the optical fiber can yield signal transmission variation, causing noise and data errors in the transmitted signal.

Extant techniques for modifying the surface tension of cured polymers typically rely on the inclusion of a liquid additive or plasticizer which does not take part in the polymer crosslink curing process. This liquid which is usually a low molecular weight lubricating fluid is present in the final cured polymer and is available to coat the surface of the cured polymer with an oily film and, thus, to reduce its surface friction characteristics.

SUMMARY OF THE INVENTION

Two methods are described for reducing surface friction in fiber optic dispensers during payout. One (mixing method) involves mixing a suitable dry lubricant such as hexagonal boron nitride powder with the uncured polymer adhesive and then applying the resulting composite mixture onto each successive layer of optical fiber as the fiber is wound onto the dispenser. This process is followed by curing of the dispenser. The other (over-coating method) is to apply the adhesive onto the winding fiber and subsequently dust the dry lubricant onto each completed layer prior to curing the dispenser. In these two methods, the lubricating powder is entrapped by the polymer adhesive and becomes bonded to the polymer matrix during the cure crosslinking process. If necessary, this bonding between the powder and the polymer adhesive may be enhanced by coating the powder with special surfactants prior to the mixing or over-coating process or by the inclusion of special coupling agent additives in the polymer adhesive mixture.

DESCRIPTION OF THE PREFERRED EMBODIMENT

Figure 1:
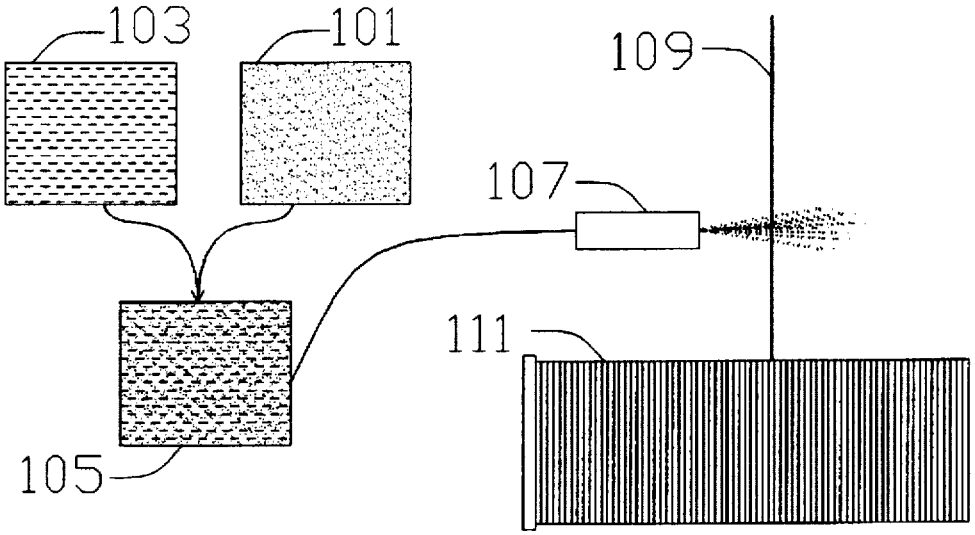
FIG. 1 illustrates the practice of the mixing method.

Referring now to the drawing wherein like numbers represent like parts in each of the several figures, the methods for reducing surface friction in fiber optic dispensers are explained in detail.

As mentioned in the "Background" above, extant techniques rely on the oily film covering the cured polymer adhesive to reduce the surface friction. Now, the use of a powder such as hexagonal boron nitride for the reduction in the cured polymer surface tension has the advantage of providing a solid surface without the tendency for the formation and transfer of oily residue films between the surfaces in contact. Lack of oily residue films has the advantage of not attracting dust or providing a media for the entrapment of surface contaminants. A solid lubricant such as boron nitride also prevents any potential solvent activity which may be present with a liquid lubricant. Further, boron nitride is chemically very stable, non-flammable and resists any potential chemical interactions with material it may contact. Boron nitride is a refractory material and can be used at temperatures in excess of the recommended maximum temperatures of all known polymer bases. Unlike many fluid additives, boron nitride does not have an appreciable vapor pressure at temperatures which can be tolerated by polymers and therefore does not show any tendency to vaporize from exposed polymer surfaces.

In the mixing method illustrated in FIG. 1, a suitable dry lubricating powder such as boron nitride 101 is blended with uncured adhesive 103 such as pressure-sensitive polymer, Dow Corning Q2-7406, to form a composite mixture 105, the boron nitride concentration being less than 10% by volume. The composite mixture is then applied onto optical fiber 109 using spray nozzle 107 while the optical fiber is being wound onto dispenser 111 in a continuous process. Upon completion of the layers, the dispenser is cured.

Figure 2:
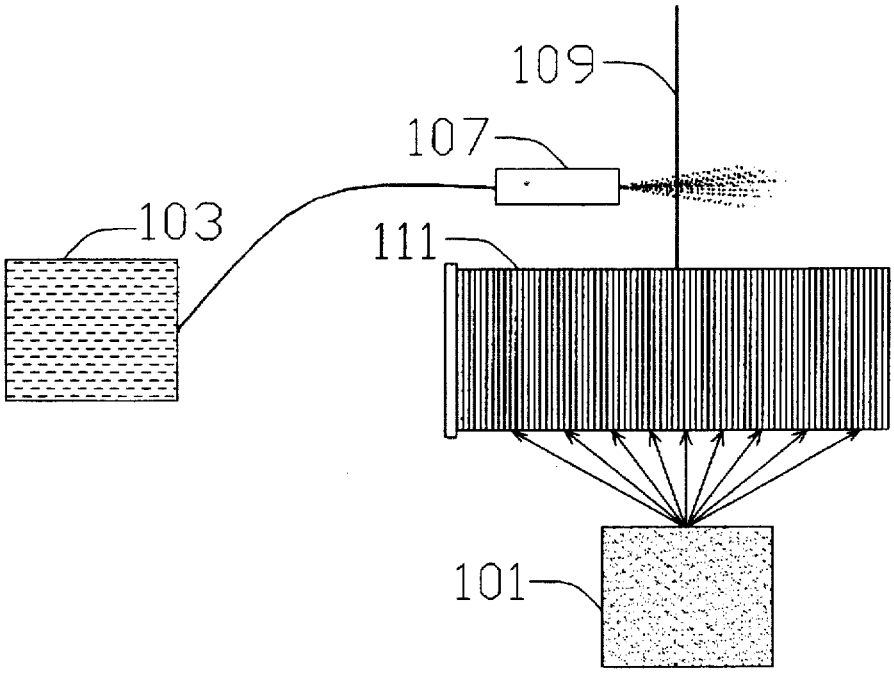
FIG. 2 illustrates the practice of the over-coating method.

In the over-coating method as illustrated in FIG. 2, adhesive 103, Dow Corning Q2-7406, is sprayed onto optical fiber 109 through spray nozzle 107 while the fiber is being wound onto dispenser 111. After the winding of a complete layer, lubricating powder 101, boron nitride, is applied by being dusted onto the outer surface of the fiber layer. Usually, less than 1 gram of boron nitride is sprinkled on each layer, each layer having a surface area of approximately 480 square inches. However, the entire amount of the boron nitride normally does not adhere to the surface and some falls off as the dispenser is rotated during the application process. In addition, an airbrush may be utilized to blow air pressurized to 30 psi onto the surface of the dispenser to remove any excess boron nitride and ensure that a minimal amount remains on the surface. It is desired to create as thin a coating of boron nitride as possible. After over-coating with the powder lubricant, the winding direction is reversed and the cycle repeats for the next layer. When all the layers have been wound, the dispenser is allowed to cure.

Tests that have been performed to determine the compatibility of boron nitride with various polymer adhesive materials used for dispenser for optical fiber payout dispensers reveal no incompatibilities. Further, the invented methods have achieved at least a 95% reduction of the forces attributed to friction during dispenser payout. Such a reduction can only result in improved fiber optic dispenser reliability during high speed deployment and should eliminate all failures due to frictional effects.

Although particular embodiments and forms of this invention have been illustrated, it is apparent that various modifications and embodiments of the invention may be made by those skilled in the art without departing from the scope and spirit of the foregoing disclosure. Accordingly, the scope of the invention should be limited only by the claims appended hereto.

We claim:

1. A method for reducing surface friction in a fiber optic dispenser during payout, said method being practiced while the fiber is initially being wound onto the dispenser and comprising the steps of:

a) coating hexagonal boron nitride powder with a pre-selected surfactant;

b) mixing the coated hexagonal boron nitride powder with an uncured, pressure-sensitive adhesive solution to create a composite sprayable solution, said coating step promoting bonding between the boron nitride powder and the adhesive solution;

c) spraying the composite solution onto each successive layer of fiber optic as the fiber is wound onto the dispenser; and d) curing the fiber optic dispenser upon completion of the winding of the fiber onto the dispenser.

* * * * *